US005690095A

United States Patent [19]

Glynn et al.

[11] Patent Number: 5,690,095

[45] Date of Patent: Nov. 25, 1997

[54] EMERGENCY ESCAPE BREATHING APPARATUS

[75] Inventors: Michael Harvey Glynn, Heckfield; Thomas Norbron, Farnborough, both of United Kingdom

[73] Assignee: Protector Technologies Limited, Lancashire, United Kingdom

[21] Appl. No.: 651,708

[22] Filed: May 21, 1996

[30] Foreign Application Priority Data

May 24, 1995 [GB] United Kingdom ..... 9510457

[51] Int. Cl.[6] ..... A62B 17/00

[52] U.S. Cl. ..... 128/201.23; 128/201.24; 128/201.25; 128/201.28; 128/201.29; 128/206.24

[58] Field of Search ..... 128/200.28, 201.12, 128/201.22, 201.23, 201.24, 201.27, 201.28, 201.29, 203.39, 206.12, 206.16, 206.24, 206.28, 207.11, 207.12

[56] References Cited

U.S. PATENT DOCUMENTS

| | | | |
|---|---|---|---|
| 2,810,386 | 11/1957 | Reed | 128/201.28 |
| 3,710,393 | 1/1973 | Douglas | 128/201.23 |
| 3,762,407 | 10/1973 | Shonerd | 128/201.23 |
| 4,231,359 | 11/1980 | Martin | 128/201.18 |
| 5,146,636 | 9/1992 | De La Pena | 128/201.27 |

FOREIGN PATENT DOCUMENTS

| | | | |
|---|---|---|---|
| 470791A | 2/1992 | European Pat. Off. | 128/201.23 |
| 0474372 | 3/1992 | European Pat. Off. | A62B 18/00 |
| 0870067 | 3/1953 | Germany . | |
| 0450345 | 7/1936 | United Kingdom | A62B 17/00 |
| 2189707 | 11/1987 | United Kingdom | A62B 7/00 |
| 2191950 | 12/1987 | United Kingdom | A62B 7/04 |
| 2210772 | 6/1989 | United Kingdom | A62B 17/04 |
| WO9314819 | 8/1993 | WIPO | A62B 18/02 |

*Primary Examiner*—Vincent Millin
*Assistant Examiner*—V. Srivastava
*Attorney, Agent, or Firm*—Volpe and Koenig, P.C.

[57] ABSTRACT

Emergency escape breathing apparatus having a hood 2 made of flexible material, an inner mask 6, supply means 4 by which respirable air may be supplied to the inner mask and a member 10 attached to the inner mask 6 which may act to hold the inner mask 6 in position, and also aids donning of the apparatus without dislodging any spectacles 3, if worn.

20 Claims, 1 Drawing Sheet

EMERGENCY ESCAPE BREATHING APPARATUS

Figure 1:
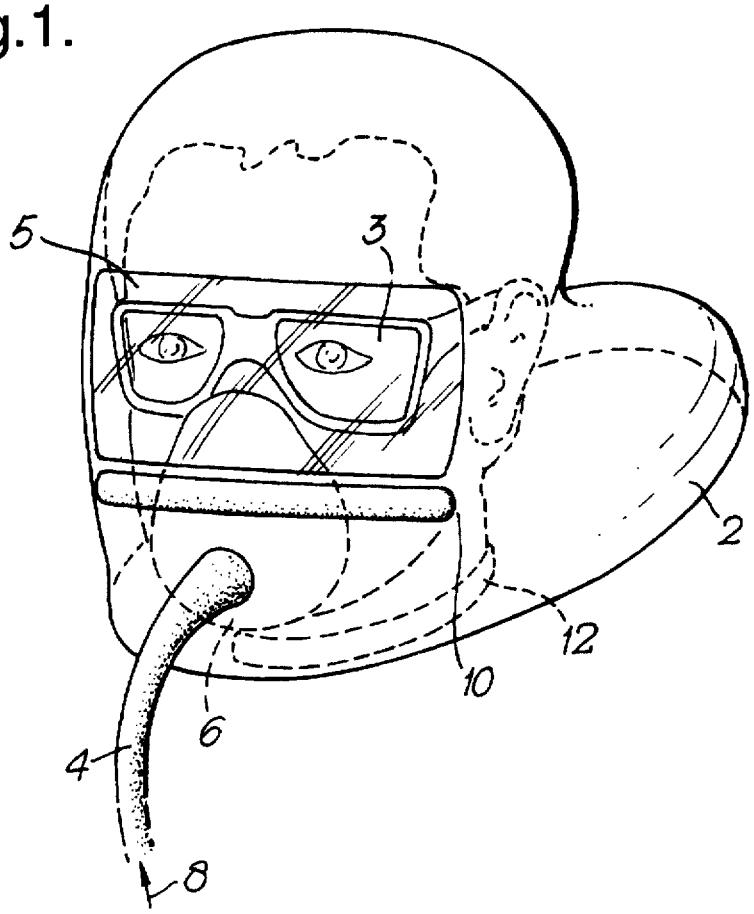

The present invention relates to emergency escape breathing apparatus and in particular to emergency escape breathing devices for escape from natural disasters, industrial accidents, fires or any situation where highly toxic substances such as gases, aerosols or powders are present in the surrounding atmosphere.

A known respiratory escape device of this type consists of a flexible hood, the interior of which is connected to a cylinder which stores a compressed breathable gas such as air. In an emergency a valve controlling the compressed gas cylinder is turned on so that the breathable gas is supplied continuously to the flexible hood which is pulled on over a person's head. This enables the person to walk through a polluted atmosphere, such as a smoky atmosphere caused by a fire, to a place of safety where the hood can be removed.

The flexible hood of such a device normally has a neck seal which surrounds the neck of a wearer and prevents the ingress of the polluted atmosphere into the interior of the hood. The neck seal also permits the escape of gasses from the interior of the hood where an increased pressure, greater than atmospheric pressure, tends to build up due to the continued supply of air, or other breathable gas to the hood. Alternatively the hood may include a separate exhale valve for limiting the gas pressure increase within the hood.

With the device described above, it is known for the breath of someone wearing the hood to be exhaled into the interior of the hood. This tends to increase the proportion of carbon dioxide inside the hood to a level which makes it undesirable for the air inside the hood to be inhaled. This is despite the fact that fresh air is being supplied continually to the interior of the hood and that $CO_2$ contaminated air continually escapes from the interior of the hood to the atmosphere. A known method of overcoming this problem is to use a baffle or other physical barrier (which often takes the form of an orinasal mask or half-mask) to provide a confined space around the wearer's nose and mouth from which exhaled breath is expelled and to which the new air or other breathable gas is supplied. Where the barrier takes the form of an orinasal mask or half-mask, difficulties are often experienced by the wearer in donning the mask and successfully positioning and maintaining the mask correctly.

It is possible to provide an external harness system to hold the mask in place after the hood has been put on. However, such a system increases the complexity of donning the hood and, furthermore, the use of an external harness necessitates using expensive, fire-proof materials in the manufacture of the harness system.

It is also known to provide an internal harness system such as an elastic tensioning band, or to make the whole or a part of the hood of an elastic material. Emergency escape breathing devices having such harness systems are described in the applicant's earlier UK Patent Application No. GB 2 247 396 A.

Despite the fact that using a resilient internal harness system allows a user to don the hood correctly, in such a manner that the mask is maintained in the correct position, the hood is inconvenient for spectacle wearers. The problem arises because the harness system together with the mask tend to dislodge spectacles from the face of the wearer as the hood is being put on. Thus, the present invention seeks to overcome the above-mentioned disadvantages and to provide emergency escape breathing apparatus which efficiently utilises fresh respirable gas stored in a gas canister and which enables a wearer to quickly, easily and correctly don the apparatus without dislodging any spectacles which may be worn.

According to the present invention there is provided emergency escape breathing apparatus comprising supply means for connection to a supply of breathable gas; a hood made of flexible material; an inner mask in communication with the supply means; resilient means for holding the inner mask in position when in use; and a member attached to the inner mask which extends at least the width of the head of a wearer of the apparatus, and which is at least semi-rigid.

By semi-rigid it is meant that the member has at least sufficient rigidity to substantially maintain its shape during normal handling and donning of the apparatus; in this way it acts at least partially as a supporting frame or skeleton for the flexible material of the hood.

The member conveniently takes the form of a bar which may be rigid, and the resilient means may take the form of an internal elastic harness, or the whole of the hood could be made of a flexible resilient material. However, in a preferred embodiment the bar itself is resilient and provides the resilient means by which the inner mask is held in position against the wearer's face to provide a confined space around the mouth and nose.

Although the member is attached to the inner mask, it need not be directly attached to the inner mask, but instead may be attached to the hood which in turn is then attached to the inner mask.

The inner mask may take the form of a simple baffle, which may be formed integrally with the hood; a preferred form, however, is that of an orinasal or half-mask which is formed separately from the hood and later attached thereto. The inner mask may communicate directly with the supply means or alternatively the supply means may supply breathable gas to the hood first and thence to the inner mask via a port or a valve.

Preferably the hood is adapted to engage the back of a wearer's head approximately level to the wearer's ears and above, while the back of the hood below the level of the wearer's ears may bulge outwardly. In any event the neck portion of the hood is preferably made of a resilient means to engage the neck of the wearer and thereby provide a seal against the external atmosphere.

Figure 2:
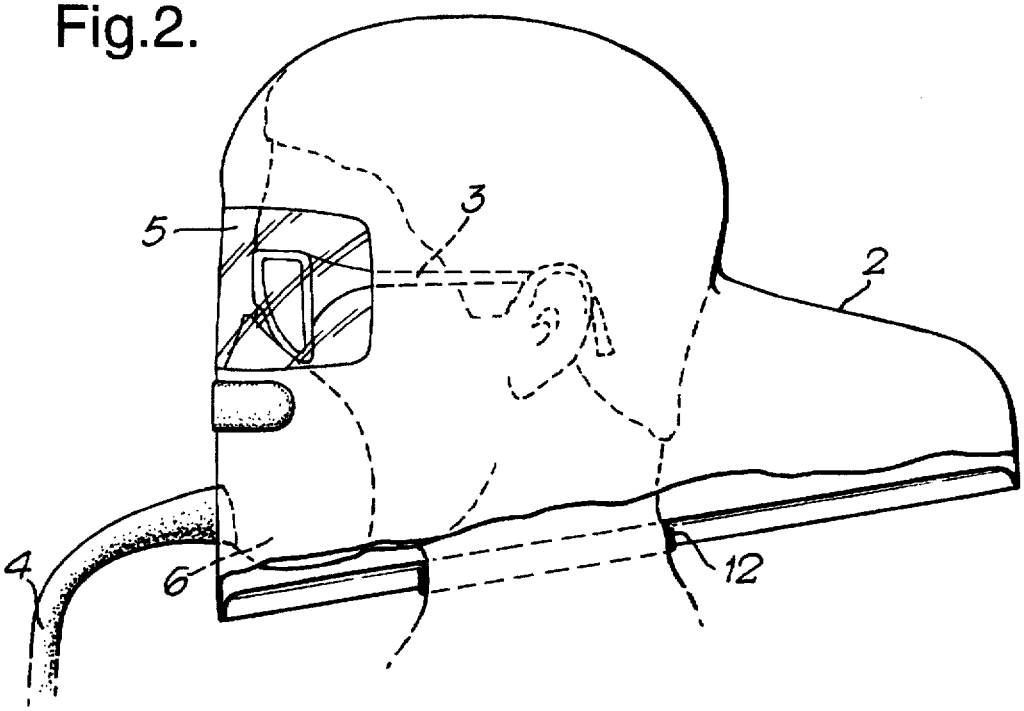

In order that the invention may be better understood an embodiment thereof will now be described, by way of example, with reference to the accompanying drawings in which:

FIG. 1 is a diagrammatical, perspective view of a preferred embodiment of the present invention, and FIG. 2 is a diagrammatical, side view of the apparatus shown in FIG. 1.

The emergency escape breathing apparatus of FIG. 1 can be seen to comprise a hood 2 having a visor portion 5, and a flexible pipe 4, through which respirable gas is caused to flow from a source 8 thereof to an orinasal mask 6. Furthermore, a bar 10 is provided which is connected to both the orinasal mask 6 and the visor 5.

The hood is made of flame retardant flexible material which may be polyurethane coated viscose which meets the enhanced flame resistance requirements of the six burner 950° C. flame test of B.S. 4667 Part 4 1989.

The hood also has a neck portion 12 which is elastic and which seals against the wearer's neck. This ensures that the interior of the hood is sealed from the external atmosphere, which may not be breathable.

When the hood is in place on the head of a wearer, as shown in the drawings, the hood is a close fit around the back of the head of the wearer approximately from the crown of the wearer's head to a region approximately level with the top of the wearer's ears. Below this level the material of the hood may be loose up to the neck seal 12. In the figures the material of the hood is shown to bulge outwardly at the back of the head. This allows space for an air-bag or other device to be accommodated if necessary.

The visor portion 5 of the hood 2 is made of transparent, flexible or semi-rigid, plastics material and is also flame retardant. The visor portion 5 extends from a level parallel to the wearer's forehead to a level just above the wearer's upper lip thereby giving an extensive field of view.

Just below the visor portion 5, the bar 10 is situated approximately parallel to the wearer's upper lip. The bar is conveniently located in a pocket formed on the inside of the hood 2 close to the point where the orinasal mask 6 attaches to the hood 2. Alternatively the bar 10 may be secured to the orinasal mask 6 within the hood.

The bar 10 is conveniently formed out of a sheet of plastics material and ideally has a length greater than the width of a pair of spectacles 3. The bar could also be made from a sheet of metal or a close coiled spring. Thus the bar 10 is resilient and, although being capable of flexure, in the absence of large external forces adopts its static shape.

In the figures, the bar 10 has a length which is greater than the width of an average sized adult head. Alternatively the hood 2 and the bar 10 may be made in different sizes to fit different sizes of heads, in each case the bar 10 being equal to or longer than the width of head which the hood 2 is intended to fit. In this way the bar 10 has a length which is equal to or greater than the width of any spectacles 3 which may be worn.

The bar 10 is made to be semi-rigid. By semi-rigid it is meant that although the bar 10 is sufficiently flexible to act as a resilient member, which keeps the orinasal mask 6 in position when the hood 2 is fitted, it is rigid enough to maintain its shape sufficiently to spread the hood 2 wider than the spectacles 3 while the hood 2 is being put on under normal circumstances. The bar ensures that the hood and the orinasal mask do not dislodge the wearer's spectacles 3, as the hood is being put on. This is done by the bar holding the hood and the mask away from the spectacles. This enables a person who wears spectacles to quickly and efficiently don the hood even in an emergency situation without having to pay attention to preventing the dislodgement of the spectacles by the hood. This is clearly a very important feature bearing in mind that in the type of stressful situation in which the hood is likely to be used, time may be short.

As the bar 10 is made of a resilient, rather than fluid-like, material it can also ensure that the hood is correctly fitted and that the orinasal-mask is kept firmly in position over the wearer's nose and mouth. This is done by the bar pressing the mask against the wearer's face. It can be seen from the drawings that once the hood is fitted the bar 10 is forced to adopt a slightly rounded shape because the hood closely fits around the upper part of the wearer's head. However, as the static shape of the bar is more linear, the bar flexes under the force of the hood to press the orinasal mask against the wearer's face.

Although the bar may be conveniently formed from a semi-rigid, resilient material, in an alternative embodiment the bar may be of a rigid material. By rigid it is meant, in this case, that under the sort of forces which will be exerted under normal usage (eg. both whilst putting on the hood 2 and when it is correctly fitted) any deformation of the bar 10 from its normal shape will be negligible. With this alternative embodiment the bar 10 still performs the function of spreading the hood so as not to dislodge the wearer's spectacles when the hood is being put on.

However, the bar will no longer be able to provide the resilience required to urge the orinasal mask against the wearer's face, regardless of the size of the wearer's head. Instead the hood may include a separate internal elastic strap which extends from one end of the bar 10 around the back of the wearer's head to the other end of the bar 10. Instead of an elastic strap part of the hood may be elasticated to effectively form the elastic strap integrally with the hood. This is preferred as it reduces the risk of the strap snagging on the wearer's ears or the arms of his spectacles during donning. Provided such a strap or elasticated portion of the hood is present, the bar will again urge the orinasal mask against the wearer's face.

The orinasal mask is conveniently made from stiff plastics material and press-moulded. Suitable masks are well-known and readily obtainable. The orinasal mask is attached to the hood where the pipe 4 attaches to the mask and the attachment is such that a good seal is provided against the external atmosphere. A valve (not shown) may also be included to release the exhaled gases to the environment or to the interior of the hood.

The source 8 of respirable gas will normally take the form of a small cylinder which stores pressurised air or other respirable gas. A typical cylinder will have a capacity of about 1 to 2 liters at pressures of about 200 bars. The cylinder will usually be fitted with a regulator which may be switched between an "on" and an "off" position, and when switched on will provide an approximately constant flow of gas until the pressure in the cylinder is reduced to atmospheric pressure.

An alternative source of respirable gas is provided by a filter which filters polluted air from the atmosphere. Such a filter may also be provided with a fan to supply a constant flow of respirable gas to the inner mask.

We claim:

1. Emergency escape breathing apparatus comprising supply means for connection to a supply of breathable gas; a hood made of flexible material; an inner mask in communication with the supply means; resilient means for holding the inner mask in position when in use; and a member attached to the inner mask which extends at least the width of the head of a wearer of the apparatus and which is at least semi-rigid so as to urge the inner mask against the wearer's face when the apparatus is worn whereby the semi-rigid member serves the dual function of maintaining the hood away from the wearer's face as the apparatus is donned and urging the mask against the users face once the apparatus is in place on the wearer's head.

2. Emergency escape breathing apparatus as claimed in claim 1 wherein said member is resilient.

3. Emergency escape breathing apparatus as claimed in claim 2 wherein said resilient means is at least partially provided by said member.

4. Emergency escape breathing apparatus as claimed in claim 1 wherein said resilient means is at least partially provided by an internal elastic harness which is attached to said hood.

5. Emergency escape breathing apparatus as claimed in claim 2 wherein said resilient means is at least partially provided by an internal elastic harness which is attached to said hood.

6. Emergency escape breathing apparatus as claimed in claim 3 wherein said resilient means is at least partially provided by an internal elastic harness which is attached to said hood.

7. Emergency escape breathing apparatus as claimed in claim 1 wherein the hood is made of an elastic material and said resilient means is at least partially provided by said hood.

8. Emergency escape breathing apparatus as claimed in claim 2 wherein the hood is made of an elastic material and said resilient means is at least partially provided by said hood.

9. Emergency escape breathing apparatus as claimed in claim 3 wherein the hood is made of an elastic material and said resilient means is at least partially provided by said hood.

10. Emergency escape breathing apparatus as claimed in claim 4 wherein the hood is made of an elastic material and said resilient means is at least partially provided by said hood.

11. Emergency escape breathing apparatus as claimed in claim 5 wherein the hood is made of an elastic material and said resilient means is at least partially provided by said hood.

12. Emergency escape breathing apparatus as claimed in claim 6 wherein the hood is made of an elastic material and said resilient means is at least partially provided by said hood.

13. Emergency escape breathing apparatus as claimed in claim 3 wherein said hood is made of a non-elastic flame-resistant material and said resilient means is wholly provided by said member.

14. Emergency escape breathing apparatus as claimed in claim 1 wherein said inner mask comprises an orinasal mask.

15. Emergency escape breathing apparatus as claimed in claim 1 wherein said inner mask is formed separately from the hood.

16. Emergency escape breathing apparatus as claimed in claim 1 wherein said member is formed integrally with said inner mask.

17. Emergency escape breathing apparatus as claimed in claim 1 wherein said member is formed separately from said inner mask and said hood and wherein said hood is formed with a pocket or similar attachment means by which said member may be attached to said hood which in turn is attached to said inner mask.

18. Emergency escape breathing apparatus as claimed in claim 1 wherein the hood is adapted to engage the back of a wearer's head approximately level with the wearer's ears and above, while the back of the hood below the level of the wearer's ears may bulge outwardly when in use.

19. Emergency escape breathing apparatus as claimed in claim 1 wherein the neck portion of the hood is made of a resilient means to engage the neck of a wearer when in use and thereby provide a seal against the external atmosphere.

20. Emergency escape breathing apparatus as claimed in claim 18 wherein the neck portion of the hood is made of a resilient means to engage the neck of a wearer when in use and thereby provide a seal against the external atmosphere.

* * * * *